US006959647B2

(12) United States Patent
Reynolds et al.

(10) Patent No.: US 6,959,647 B2
(45) Date of Patent: Nov. 1, 2005

(54) CARTRIDGE FOR A FIREARM

(75) Inventors: S. Paul Reynolds, Altona, IL (US); George L. Reynolds, Altona, IL (US)

(73) Assignee: Mark A. Wistrom, Geneseo, IL (US)

( * ) Notice: Subject to any disclaimer, the term of this patent is extended or adjusted under 35 U.S.C. 154(b) by 0 days.

(21) Appl. No.: 10/714,693

(22) Filed: Nov. 17, 2003

(65) Prior Publication Data

US 2004/0107859 A1 Jun. 10, 2004

Related U.S. Application Data

(63) Continuation-in-part of application No. 10/353,448, filed on Jan. 29, 2003, now abandoned, which is a continuation-in-part of application No. 10/119,319, filed on Apr. 9, 2002, now abandoned, and a continuation-in-part of application No. PCT/US00/41478, filed on Oct. 25, 2000, which is a continuation-in-part of application No. 09/426,285, filed on Oct. 25, 1999, now Pat. No. 6,367,389.

(51) Int. Cl.[7] ..... F42B 5/26

(52) U.S. Cl. ..... 102/470; 102/430; 102/439; 102/467

(58) Field of Search ..... 102/430, 467, 102/470, 466, 439

(56) References Cited

U.S. PATENT DOCUMENTS

| | | | | |
|---|---|---|---|---|
| 27,933 A | | 4/1860 | Smith et al. | |
| 62,283 A | | 1/1867 | Millbank | |
| 102,675 A | | 5/1870 | Gatling | |
| 121,808 A | | 12/1871 | Payne | |
| 125,640 A | | 4/1872 | Wesson | |
| 172,716 A | | 1/1876 | Dimock | |
| 268,601 A | | 12/1882 | Bailey | |
| 592,942 A | | 11/1897 | Tichenor | |
| 692,154 A | | 1/1902 | Lammadin et al. | |
| 933,030 A | | 8/1909 | Funk | |
| 1,082,975 A | | 12/1913 | Rylands | |
| 1,345,565 A | | 7/1920 | Thompson | |
| 1,461,013 A | | 3/1923 | Hodge | |
| 1,491,000 A | | 4/1924 | Brandt et al. | |
| 2,379,056 A | | 6/1945 | Alexander | |
| 2,522,208 A | | 9/1950 | Catlin | |
| 2,793,455 A | | 5/1957 | Wignall | |
| 3,050,894 A | | 8/1962 | Ivy | |
| 3,359,903 A | * | 12/1967 | Sobolewski | 102/466 |
| 3,477,374 A | * | 11/1969 | Barr | 102/470 |
| 3,609,904 A | * | 10/1971 | Scanlon | 102/466 |
| 3,613,584 A | * | 10/1971 | Hendricks | 102/439 |
| 3,786,761 A | | 1/1974 | Ciccone et al. | |
| 3,855,900 A | | 12/1974 | Barr et al. | |
| 3,911,821 A | | 10/1975 | Finot et al. | |
| 4,085,677 A | * | 4/1978 | Marcinkiewicz | |
| 4,132,173 A | | 1/1979 | Amuchastegut | |
| 4,316,341 A | | 2/1982 | Landry | |
| 4,353,304 A | | 10/1982 | Hubsch et al. | |
| 4,424,638 A | | 1/1984 | Hillberg | |

(Continued)

FOREIGN PATENT DOCUMENTS

| | | | | |
|---|---|---|---|---|
| AU | 403856 A1 | | 10/1969 | |
| DE | 004408774 | * | 3/1994 | 102/470 |
| WO | WO 01/46637 A2 | | 6/2001 | |

*Primary Examiner*—Michael J. Carone
*Assistant Examiner*—L. Semunegus
(74) *Attorney, Agent, or Firm*—Woodard, Emhardt, Moriarty, McNett & Henry LLP

(57) ABSTRACT

A cartridge for firearms includes a bullet connected to a casing. The casing includes a cylindrical wall that extends to an end member opposite the bullet, a hollow interior formed by the wall and the end member, and a receptacle for receiving a priming composition. Anvils or projections are provided in the casing to compress the priming composition between the end member and the projection or anvil with a firing pin engaging the end member. Propellant in the hollow interior is ignited by the compressed priming composition.

19 Claims, 10 Drawing Sheets

U.S. PATENT DOCUMENTS

| | | | |
|---|---|---|---|
| 4,615,133 | A | 10/1986 | Center |
| 4,848,237 | A | 7/1989 | Zedrosser |
| 4,955,157 | A | 9/1990 | Brighton et al. |
| 5,157,219 | A | 10/1992 | Calsson et al. |
| 5,481,978 | A | 1/1996 | Muller et al. |
| 5,490,463 | A | 2/1996 | Lamberty et al. |
| 6,516,725 | B2 | 2/2003 | Jackson et al. |
| 2002/0189486 | A1 | 12/2002 | Westrom |

* cited by examiner

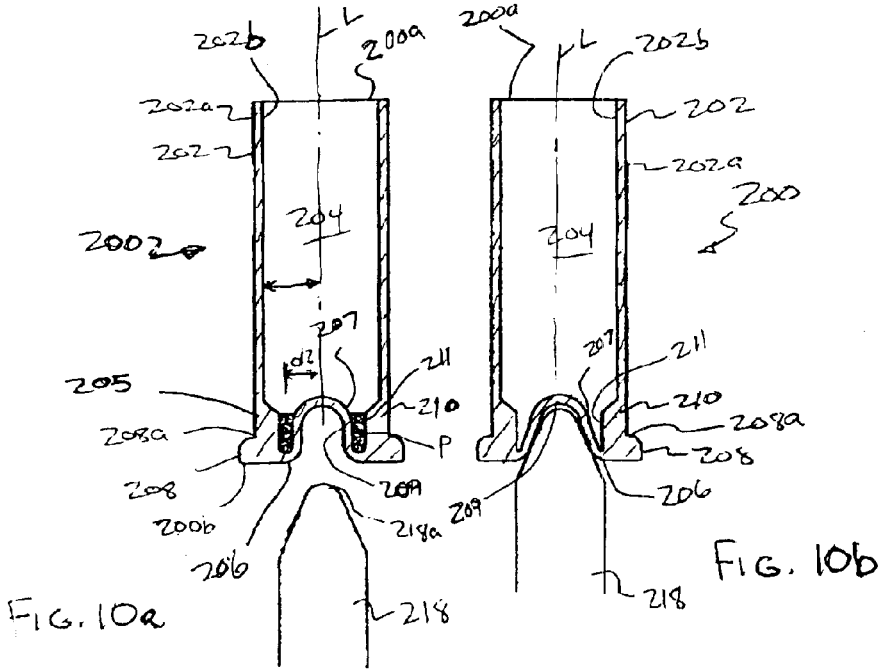
FIG. 10a
FIG. 10b
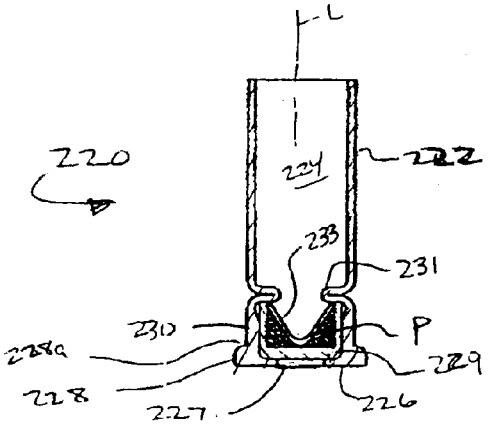
FIG. 11
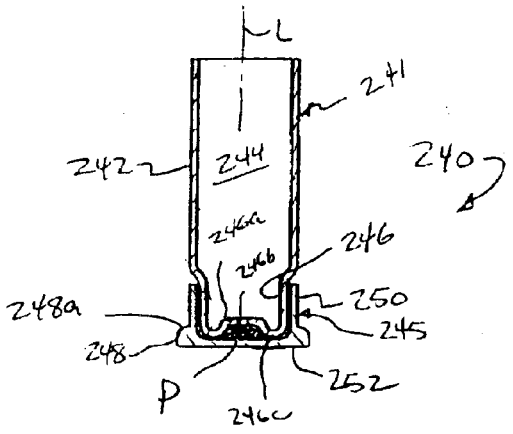
FIG. 12

CARTRIDGE FOR A FIREARM

CROSS-REFERENCE TO RELATED APPLICATIONS

This application is a continuation-in-part of U.S. patent application Ser. No. 10/119,319 filed on Apr. 9, 2002 now abandoned, which is a continuation-in-part of U.S. patent application Ser. No. 09/426,285, filed on Oct. 25, 1999, and now issued as U.S. Pat. No. 6,367,389, each of which is hereby incorporated by reference in its entirety. U.S. patent application Ser. No. 10/119,319 is also a continuation-in-part of International Patent Application No. PCT/US00/41478, filed on Oct. 25, 2000, which claims priority to U.S. patent application Ser. No. 09/426,285, now issued as U.S. Pat. No. 6,367,389, which are also hereby incorporated by reference in their entirety. This application is also a continuation-in-part of U.S. patent application Ser. No. 10/353,448, filed on Jan. 29, 2003 now abandoned, which is hereby incorporated by reference in its entirety.

BACKGROUND

The present invention relates generally to the field of firearms, and more particularly, but not exclusively, to improved cartridge designs.

The most popular cartridge used when firing a firearm is the .22 caliber rimfire cartridge. Rimfire ammunition is often used because it is relatively inexpensive as compared to center fire ammunition. Thus, rimfire ammunition allows greater use of the firearm with less cost for such activities as recreational shooting, weapons training, hunting, and the like. Rimfire ammunition may also be used with firearms that conventionally fire more expensive ammunition, such as military weapons. These types of weapons may be adapted to fire the lower cost rimfire ammunition during training exercises with the firearm, thus saving on training expense.

One example of a rimfire cartridge is illustrated in FIG. 1 and designated generally at 10. Rimfire cartridge 10 includes a bullet 12 connected to a casing 14 at crimped portion 17. Opposite bullet 12, the casing 14 has a rearward end member 16. Casing 14 also includes a wall 22 having an inner surface 22*a* and an outer surface 22*b*. Wall 22 and end member 16 define a hollow interior 24. Projecting radially outward from wall 22 and extending between wall 22 and end member 16 is annular outer rim 18. Outer rim 18 defines an annular pocket 20 communicating with hollow interior 24. As is well known in the art, when the cartridge 10 is manufactured, a quantity of fluid priming composition 28 is spun into annular pocket 20 and allowed to dry. A quantity of powder 26 is then placed within hollow interior 24 of casing 14. In order to fire the cartridge, a firing pin configured to sharply strike casing 14 at outer rim 18 crushes the priming composition in annular pocket 20 which in turn ignites powder 26. Powder 26 burns rapidly and creates gas as it burns. The pressure from the gas forces bullet 12 from crimped portions 17 and propels bullet 12 down the barrel of the firearm.

One of the drawbacks with such rimfire cartridges is that casing 14 suffers from low strength and is prone to failure, particularly at rim 18, when casing 14 is used for a high velocity cartridge. Thus, even though the capacity of casing 14 can hold a sufficient quantity of powder to produce a high pressure cartridge, casing 14 will fail due to the higher pressures generated by the larger quantity of burning powder. This results in less powder being used with the cartridge to minimize the risk of casing failure. The reduced amount of powder causes less gas pressure to be generated by the burning powder. This in turn lowers the velocity and the energy of the bullet when it is fired.

Center fire cartridges are popular for their ability to generate high bullet velocities. However, center fire cartridges can be expensive and difficult to manufacture.

There remains a need for cartridges which effectively addresses the problems of casing strength, expense and manufacturing difficulties associated with prior art cartridges. The cartridges should be capable of use in existing firearms with minimum modification to its components, and the cartridges should have application with all caliber firearms. The present invention is directed towards meeting these needs, among others.

SUMMARY

The present invention is directed to cartridges for rimfire and center fire ammunition. The present invention further includes firing pins for firing rim fire and center fire ammunition. These and other forms, embodiments, aspects, features, advantages and objects of the invention will be apparent from the following description of the illustrated embodiments.

BRIEF DESCRIPTION OF THE DRAWINGS

FIGS. 10*a* and 10*b* are cross-sectional views of another embodiment casing and firing pin.

FIG. 11 is a cross-sectional view of another embodiment casing.

FIG. 12 is a cross-sectional view of another embodiment casing.

DESCRIPTION OF THE ILLUSTRATED EMBODIMENTS

Figure 1:
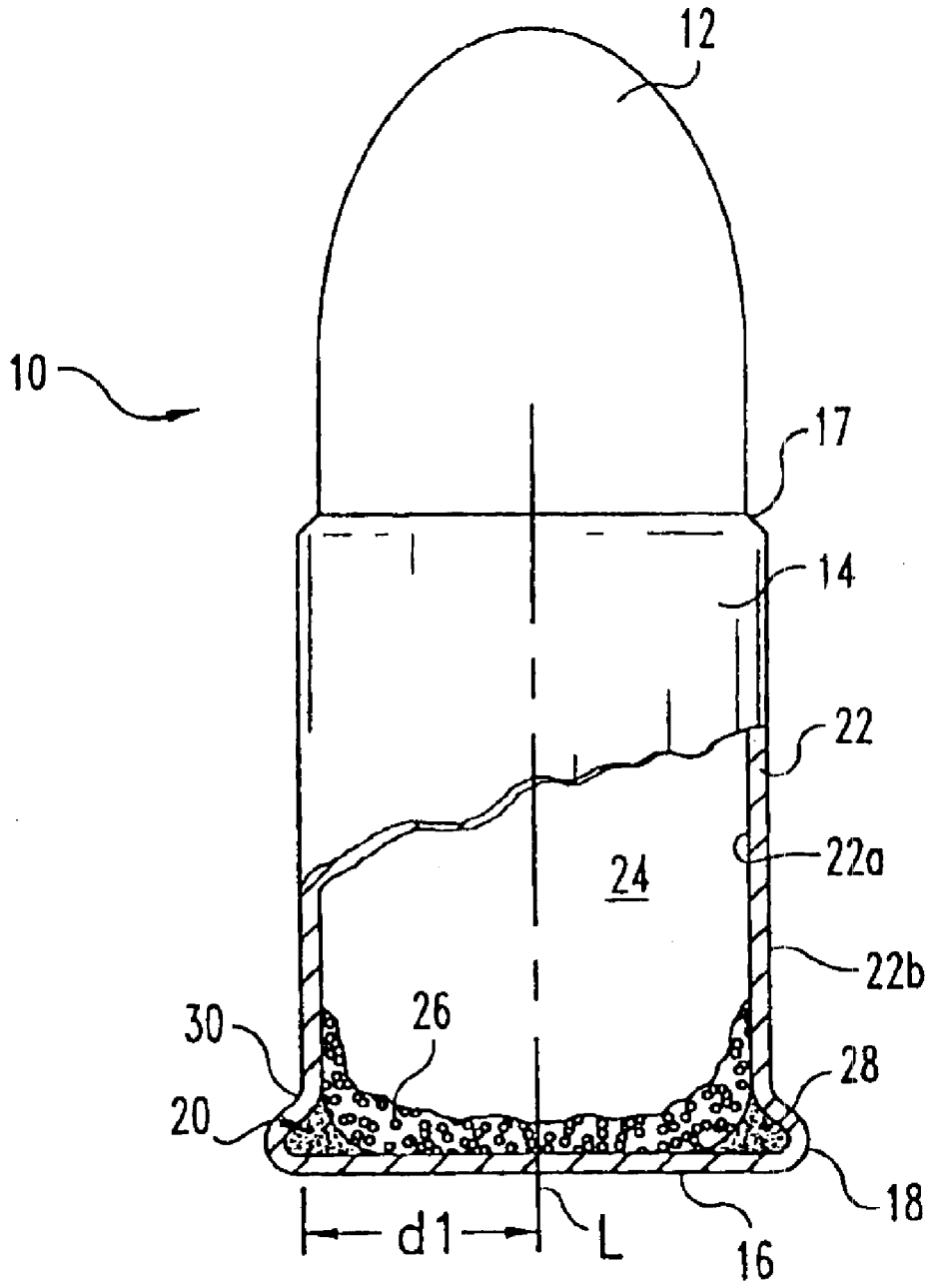
Fig. 1 (PRIOR ART)
FIG. 1 is a partial elevation and partial section view of a prior art rimfire cartridge.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated device, and any such further applications of the principles of the invention as illustrated therein are contemplated as would normally occur to one skilled in the art to which the invention relates.

Figure 2:
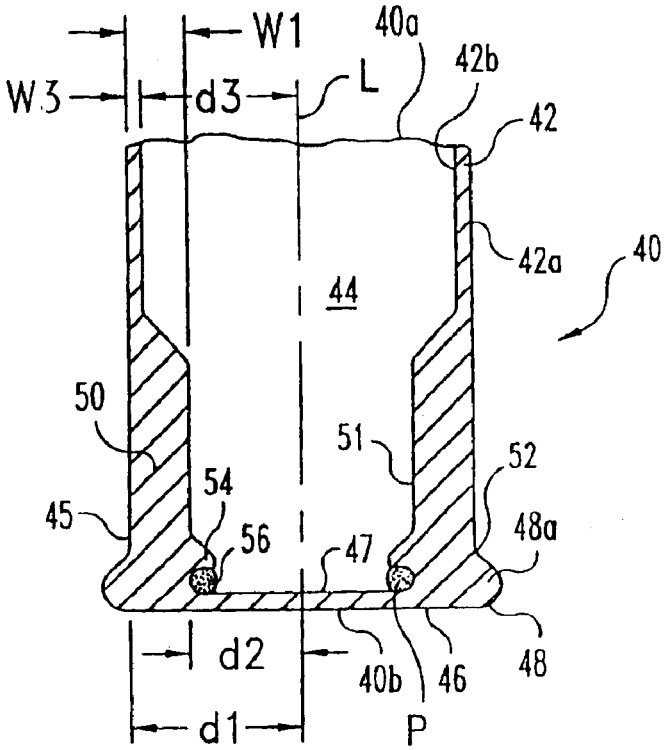
FIG. 2 is a partial cross-sectional view of a casing of a firearm cartridge.

Referring now to FIG. 2, there is illustrated a partial section view of a casing for a firearm cartridge. Casing 40 is of generally cylindrical configuration about centerline axis L and includes a wall 42 having outer surface 42*a* and inner surface 42*b*. Wall 42 has a thickness w3 and inner surface 42*b* is spaced a distance d3 from axis L. Wall 42 has a thickened wall segment 50 extending along at least a portion of the wall 42. Thickened segment 50 has an inner surface 51, and a width w1 that is greater than width w3 of wall 42. It is also contemplated herein that wall 42 may have a thickness that corresponds to w1 along a substantial portion of its length. It is further contemplated that wall 42 may taper in width from w3 to w1 along the length of wall 42.

Casing 40 has first end portion 40*a* opposite end portion 40*b*. End portion 40*b* is configured to provide cup 45 terminating in end member 46. A flange 48 is formed adjacent to end member 46, and extends between the end member 46 and thickened wall segment 50. Flange 48 extends away from centerline axis L and radially outwardly from wall 42, forming an annular lip 48*a* with outer surface 42*a*. In the illustrated embodiment, flange 48 is a solid rim that reinforces casing 40 in the region of cup 45 where wall 42 meets end member 46, and does not define a folded annular pocket, unlike the casing of FIG. 1. Also contemplated is a casing that does not include a flange forming an annular lip with the casing.

Wall 42 and cup 45 define hollow interior 44. Projection 54 extends from inner surface 51 of thickened wall segment 50 to form a recess 56 on the inner surface of the wall. Recess 56 is positioned between end member 46 and projection 54. Recess 56 receives and retains priming composition P that is placed therein. Priming composition P may be spun or otherwise placed into recess 56 using techniques known to those skilled in the art. In one embodiment, projection 54 and recess 56 each annularly extend around and encircle centerline axis L. Relative to cartridge 10 of FIG. 1, casing 14 has an annular pocket 20 formed by outer rim 18 that is spaced a distance d1 from centerline axis L of the casing 14. In contrast, recess 56 of casing 40 is spaced a distance d2 from centerline axis L, the distance d2 being less than distance d1. In one form, distance d2 is also less than distance d3 from the centerline axis L to the inner wall surface 42*b* of wall 42.

Figure 3:
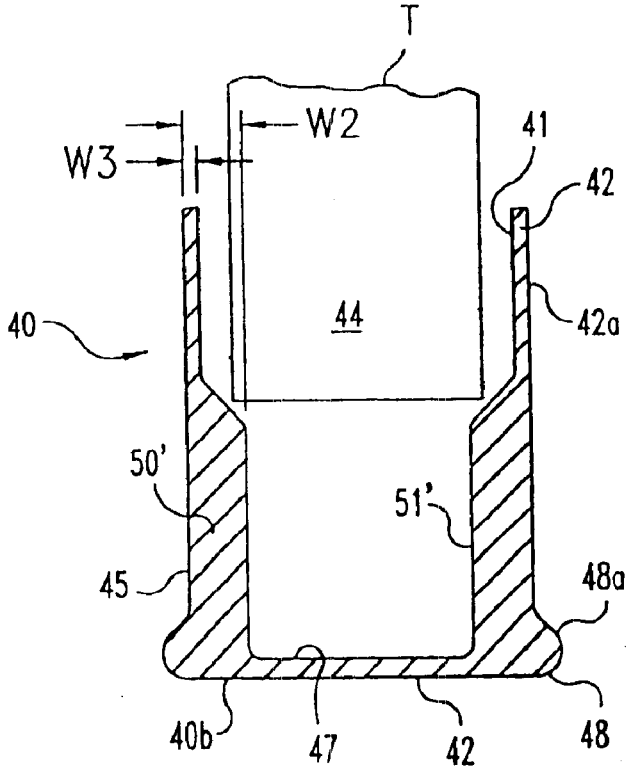
FIG. 3 is a partial cross-sectional view of the casing of FIG. 2 prior to forming the projection in the casing.

Referring now to FIG. 3, casing 40 is illustrated without projection 54 on the wall 42. Thickened wall segment 50' has a thickness w2 which is greater than thickness w1 of wall segment 50. In this embodiment, projection 54 is formed by displacing a portion of the thickened wall segment 50' through plastic deformation. In one form, this deformation takes place by inserting a tool T through opening 41 having a dimension corresponding to w1. Tool T is centered with respect to centerline axis L and advanced towards end member 46 to broach a portion of cup 45 and form projection 54 where its advancement stops. Correspondingly, the material is displaced a sufficient distance downward and in sufficient quantity to form projection 54 at the desired location above bottom surface 47, thus creating recess 56 as shown in FIG. 2. In other embodiments, a different machining or formation technique may be utilized to provide projection 54 that may or may not use casing 40 in the FIG. 3 configuration.

Figure 4:
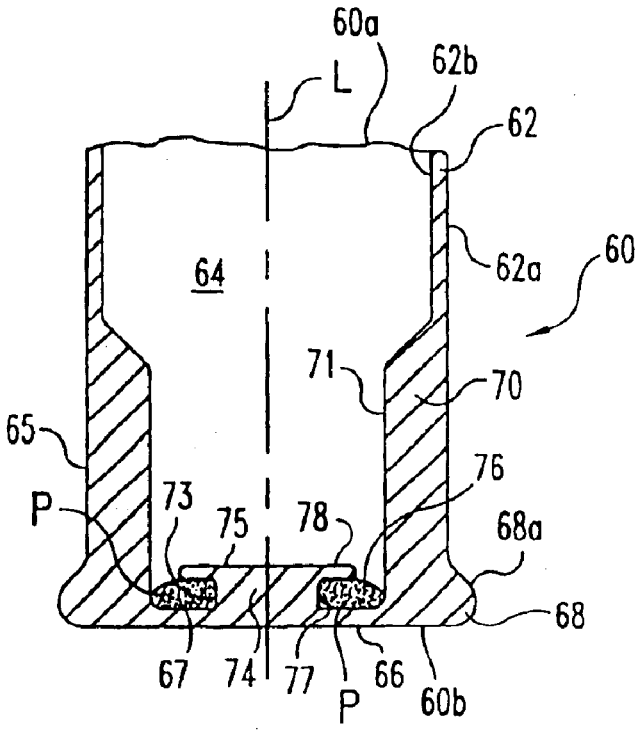
FIG. 4 is a partial cross-sectional view of the casing of another embodiment cartridge.

Referring to FIG. 4, there is illustrated another embodiment of a casing for a firearm cartridge. Wall 62 extends from first end portion 60*a* to end portion 60*b* of casing 60. Wall 62 has outer surface 62*a* and inner surface 62*b*. Wall 62 includes a thickened segment 70 having an inner surface 71. End portion 60*b* is configured to provide cup 65 terminating in end member 66. The wall 62 and end member 66 define hollow interior 64. A flange 68 is formed adjacent to end member 66, and extends between the end member 66 and thickened wall segment 70. Flange 68 extends away from centerline axis L and radially outwardly from wall 62, forming an annular lip 68*a* with outer surface 62*a*. Flange 68 can be solid to reinforce casing 60 in the region of cup 65 where wall 62 meets end member 66.

Figure 5:
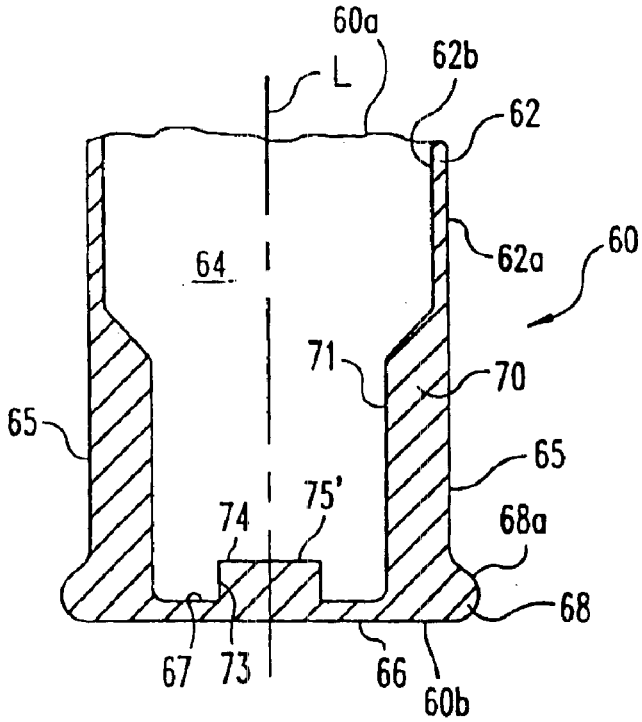
FIG. 5 is a partial cross-sectional view of the casing of FIG. 4 prior to forming the projection in the casing.

End member 66 has inner bottom surface 67. Casing 60 includes a post 74 with first end 73 connected to bottom surface 67. First end 73 is integrally formed with end member 66. Referring to FIG. 5, a second end or top 75 of post 74 is deformed by a compression load, thermal technique, or other method to define projection 78 that extends radially outwardly around post 74 at top 75. Projection 78 defines a recess 76 between it and end member 66. In this embodiment, priming composition P may be placed to rest in the bottom of cup 65 on end member 66 before formation of projection 78.

Figure 6:
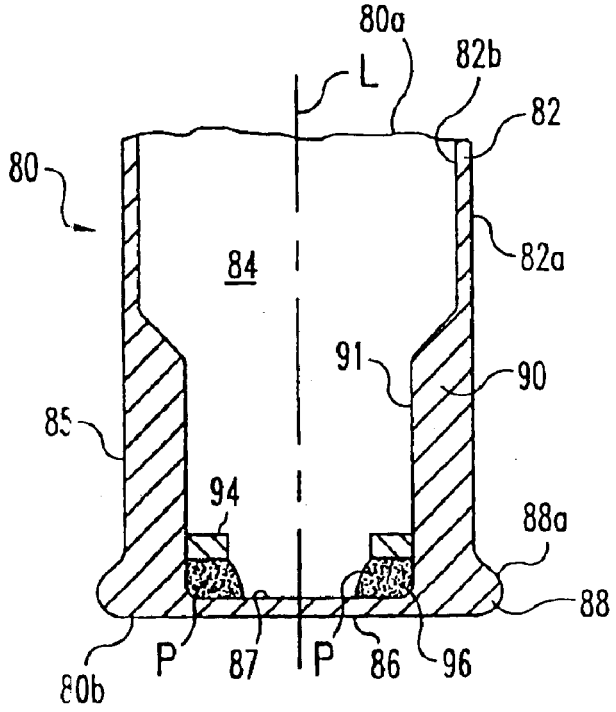
FIG. 6 is a partial cross-sectional view of another embodiment casing for a firearm cartridge.

In FIG. 6, there is shown a further embodiment of a casing for a firearm cartridge. Casing 80 includes wall 82 having outer surface 82*a* and inner surface 82*b*. Wall 82 also includes thickened segment 90 extending along at least a portion of the length of the wall. Casing 80 has end portion 80*a* opposite end portion 80*b*. End portion 80*b* is configured to provide cup 85 terminating in end member 86. A flange 88 is formed adjacent to end member 86, and extends between the end member 86 and thickened wall segment 90. Flange 88 extends away from centerline axis L and radially outward from wall 82, forming an annular lip 88*a* with outer surface 82*a*.

Wall 82 and end member 86 define hollow interior 84. A projecting member 94 is inserted into hollow interior 84 and positioned adjacent end member 86 so that it extends radially into hollow interior 84. Projecting member 94 is connected to inner wall surface 91 of thickened portion 90, and forms recess 96 on the wall 82. Recess 96 is formed between projecting member 94 and end member 86. Projecting member 94 may be connected to wall 82 using any one of a number of techniques, such as, for example, welding, applying an adhesive, or applying heat treatment. In one embodiment, projecting member 94 is in the form of a continuous ring, and projecting member 94 and recess 96 each extend annularly and encircle centerline axis L. In other embodiments, projecting member 94 is a ring having interruptions about centerline axis L.

It should be appreciated that casings 60, 80 of FIGS. 4 and 6 have a recess for receiving priming composition P positioned at a distance from centerline axis L of the casing that is less than the distance d1 of the prior art rimfire cartridge. As described above with respect to FIGS. 2–3, this distance is also preferably less than the distance d3 measured between centerline axis L and the inner wall surface of the casing.

Among the advantages realized by the present invention is that the flange and thickened wall portion provide increased strength to the casing as compared to prior art rimfire cartridges. This allows casing 14 to be loaded with pressures normally associated with higher velocity center fire cartridges. The ability to increase the pressure in the casings of the present invention allows the cartridge to fire a bullet with a greater velocity and energy with reduction or elimination of failures or "blow-outs." Release of powder or propellant gases from the cartridge ejector are also reduced or eliminated since the flange and thickened wall portion increase the strength of the casing where the ejector cut in the firearm bolt supports the cartridge. The present invention also enables the use of suitable propellants and priming composition designed to generate higher gas pressures and bullet velocities than are attainable with prior art rimfire cartridges.

Figure 7:
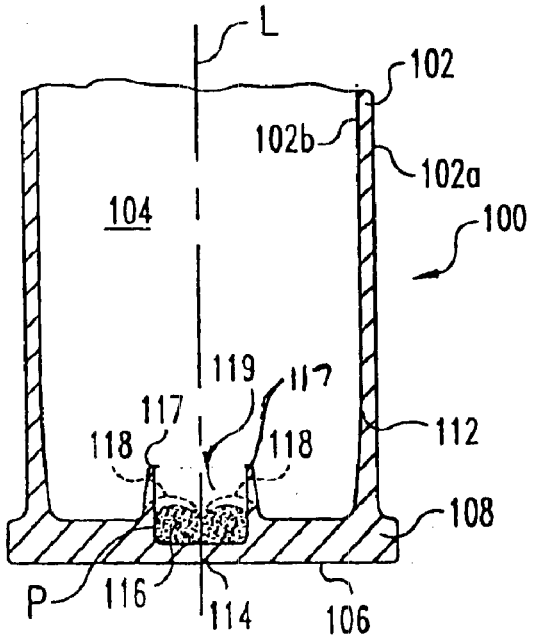
FIG. 7 is a partial cross-sectional view of another embodiment casing for a firearm cartridge.

Referring now to FIG. 7, there is illustrated a casing for a center fire cartridge. Center fire cartridge 100 includes wall 102 having an outer surface 102*a* and inner surface 102*b*. Casing 100 defines hollow interior 104 for holding powder or other suitable propellant therein. A centerline axis L extends through casing 100. Casing 100 has end member 106 and a flange 108 formed with thickened wall portion 112 and end member 106. A priming composition recess or cup 116 is formed in end member 106 in communication with hollow interior 104. End member 106 has a reduced thickness portion 114 at cup 116. Reduced thickness portion 114 is positioned on axis L for striking with center-fire firing pin. One or more extensions 117 extend upwardly from end member 106 into hollow interior 104 around reduced thickness portion 114. Extensions 117 are crimped or otherwise deformed to form two or more anvil portions 118. The anvil portions 118 are deformed so that each of the two or more anvil portions 118 are positioned over priming pocket 116.

When a firing pin strikes reduced thickness portion 114, the priming composition in priming composition pocket 116 is crushed between reduced thickness portion 114 and anvil portions 118. This detonates the priming composition, which then flashes through opening 119 between the anvil portions 118. The priming composition flash then ignites the powder or propellant and the bullet is fired. The cartridge of FIG. 7 is advantageous over other center fire cartridges since, among other reasons, it is not necessary to place a relatively expensive primer cup assembly in the end member of the casing, which is subject to gas leakage between the primer cup and primer pocket or recess formed in the casing formed to receive the cup.

Figure 8:
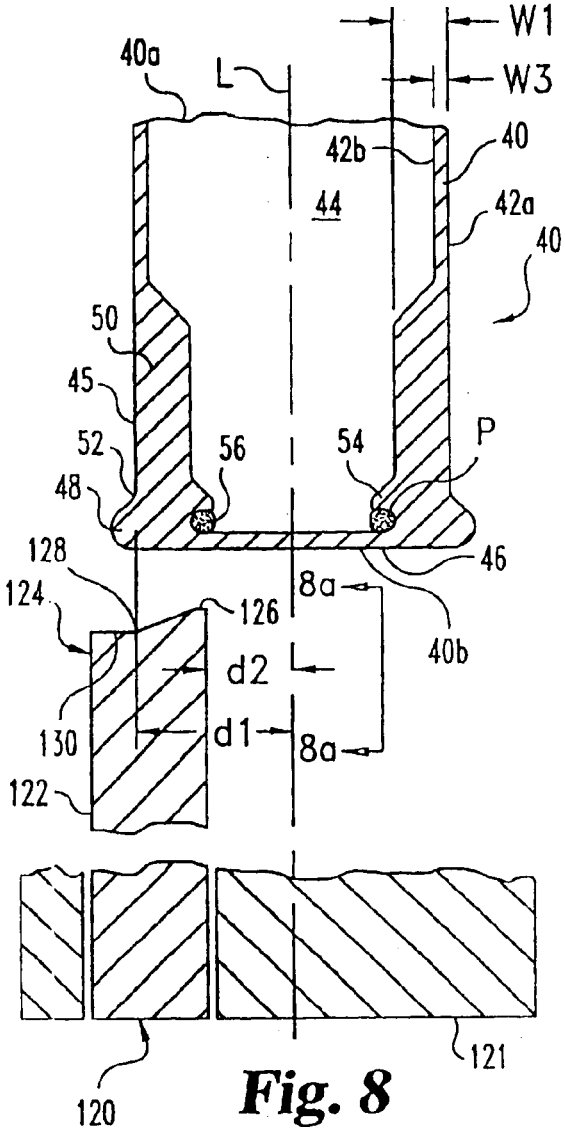
FIGS. 8 and 8*a* are partial cross-sectional views of the casing of FIG. 2 with a firing pin.
Figure 8A:
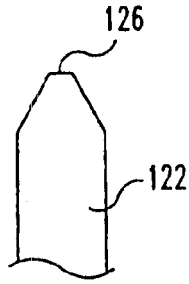

Referring now to FIG. 8, a firing pin 120 is provided that is configured to detonate the priming compositions of the cartridges discussed herein. The barrel and details of bolt 121 of the firearm are not shown but are known and understood by those skilled in the art. Firing pin 120 has a body 122 having a configuration like the body of any firing pin known to those skilled in the that is used to fire .22 caliber rimfire cartridges. Firing pin 120 also has a striking end 124. Striking end 124 has leading tip 126, positioned at a distance d2 from centerline axis L. Leading tip 126 terminates in a wedge-shaped point. Striking end 124 forms a chisel point, as shown in FIG. 8*a*, that extends from leading tip 126 to trailing tip 128. Trailing tip 128 is positioned a distance d1 from centerline axis L. In one form, a shoulder 130 extends axially from trailing tip 128 a sufficient distance such that the shoulder 130 contacts the rearward wall of the cartridge chamber housing the cartridge when the firearm is discharged.

For the purposes of clarity, firing pin 120 is shown adjacent casing 40. However, it should be understood that firing pin 120 also has application with the other embodiments of casings discussed herein. As shown with respect to casing 40, when the cartridge having casing 40 is chambered in a firearm, firing pin 120 has leading tip 1-26 for contacting end member 46 such that end member 46 is pushed inward against projection 54. This crushes or compresses the priming composition disposed within recess 56 and causes it to detonate, which, in turn, ignites the powder or propellant placed within hollow interior 44. Trailing tip 128 is positioned such that if a prior art cartridge, such as cartridge 10 of FIG. 1, is chambered in the firearm instead of cartridge 40, trailing tip 128 strikes end member 16 at rim 18, crushing the priming composition 28 and causing it to detonate, which in turn ignites the powder or propellant in the casing. The leading tip 126 when striking a prior art rimfire cartridge pushes the end member 16 into the bore 24 at a distance d2 from axis L without detonating the priming composition until trailing tip 128 strikes the casing end member at rim 18.

Figure 9A:
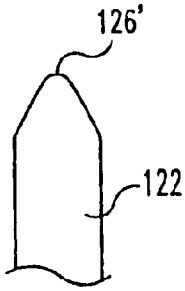
FIGS. 9 and 9*a* are partial cross-sectional view of another embodiment firing pin.
Figure 9:
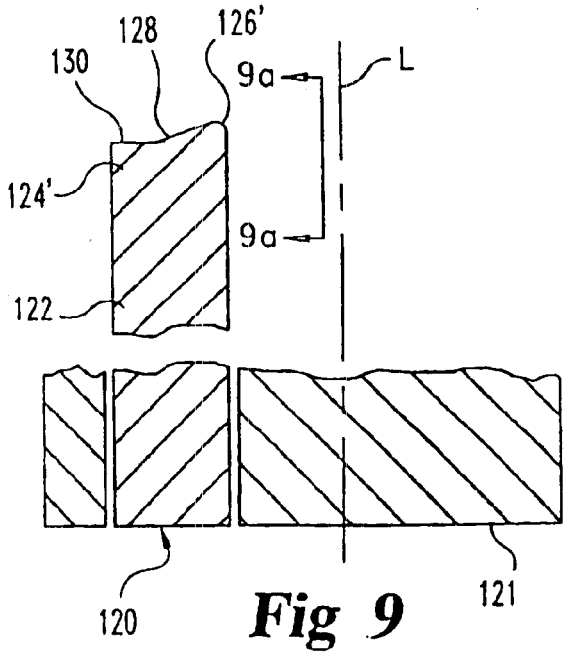

In FIG. 9, an alternate embodiment of firing pin 120 is designated at 120'. Firing pin 120' is similar to firing pin 120, however, striking end 124' has a leading tip 126' with a rounded profile forming a blunt nose. The rounded profile, shown in FIG. 9*a*, extends from leading tip 126' to trailing tip 128'.

It should be understood that also contemplated is the use of a firing pin that is designed solely to strike the end member of the cartridge at a distance d2 from the centerline axis L of the cartridge. It should also be understood that such a firing pin could be used in conjunction with a firing pin selector so that the user of the firearm can selectively fire prior art rimfire cartridges, center fire cartridges, and cartridges with casings discussed herein.

Further embodiments of cartridges for firearms are also contemplated. In FIGS. 10*a* and 10*b*, casing 200 includes wall 202 having outer surface 202*a* and inner surface 202*b*. Wall 202 also includes thickened segment 210 extending along at least a portion of the length of the wall. Casing 200 has end 200*a* opposite end 200*b* which terminates in end member 206. A flange 208 is formed adjacent to end member 206, and extends between the end member 206 and thickened wall segment 210. Flange 208 extends away from centerline axis L and radially outward from wall 202, forming an annular lip 208*a* with outer surface 202*a*.

Wall 202 and end member 206 define hollow interior 204. End member 206 has a projecting portion 209 extending into hollow interior 204, forming a priming composition recess between inner convex surface 207 of projecting portion 209 and inner surface 211 of thickened wall segment 210. Projecting portion 209 forms a cavity in end member 206 positioned to receive the end of firing pin 218. Priming composition P can be placed in the recess between projecting portion 209 and thickened wall segment 210. Casing 200 has a recess for receiving priming composition P positioned at distance d2 from centerline axis L of the casing that is less than the distance d3 between centerline L and inner wall surface 202*b*.

Firing pin 218 has a tip 218*a* sized to fit within the cavity, and is tapered to increase in size from tip 218*a*. The tapered portion of firing pin 218 contacts the outer surface of projecting portion 209 and pushes projecting member 209 toward thickened wall segment 210. Thickened wall segment 210 acts as an anvil against which priming composition P is compressed with inner surface 207 of projecting member 209. Compression of priming composition P ignites the powder or propellant in casing 200 to fire the bullet.

Referring now to FIG. 11, there is shown casing 220 that includes a wall 222 and an end member 226. A hollow interior 224 is defined by wall 222 and end member 226. A flange 228 extends radially from wall 222 adjacent end member 226, and defines a lip 228*a* with the outer surface of wall 222. Wall 222 includes a thickened segment 230 adjacent end member 226. Thickened wall segment 230 includes an inner surface that is offset into hollow interior 224 with respect to the inner wall surface of the upper portion of wall 222.

A priming composition receptacle 229 is positioned in hollow interior 224 adjacent end member 226. Thickened wall segment 230 extends around receptacle 229. Priming composition P is placed in receptacle 229 through the top of casing 220, or can be pre-placed in receptacle 229. In the illustrated embodiment, priming composition P is spun to primarily place priming composition P at the periphery of receptacle 229. Wall 222 is crimped or otherwise deformed above thickened segment 230 with the inward extension 231 of wall 222 above cup 229 to retain receptacle 229 in position in hollow interior 224. Inward extension 231 can extend around all or a portion of receptacle 229. An anvil 233 is placed over priming composition P in receptacle 229 either before or after forming inward extension 231. Anvil 233 has an inverted V shape with its ends bearing against inward extension 231.

End member 226 can have a passage 227 to at least partially receive the firing pin therein to contact receptacle 229. The firing pin compresses priming composition P between the receptacle 229 and anvil 233 to ignite the powder or propellant in casing 220. Other embodiments contemplate that receptacle 229 is not provided, but rather priming composition P is placed directly in hollow interior 224 adjacent end member 226.

Referring to FIG. 12, there is shown a cartridge with a two piece casing 240 having an upper portion 241 and a lower portion 245. Upper portion 241 has a wall 242 and a bottom anvil 246, which define hollow interior 224. Anvil 246 is radially inset with respect to wall 242 for positioning in lower portion 245. Lower portion 245 has a cup shape defined by an end member 252 and a wall 250 extending therearound. A flange 248 extends radially from wall 250 and defines a lip 248*a* therearound.

Priming composition P is placed in lower portion 245 along end member 252. Lower portion 245 thus also functions as a primer receptacle. Anvil 246 is placed in lower portion 245 and secured thereto. Anvil 246 includes a lower rim 246*c* and a raised portion 246*a* with a through-hole 246*b* to vent the flash from priming composition P to ignite powder or propellant in hollow interior 244 when the firing pin compresses priming composition P between anvil 246 and end member 252. With priming composition P located below raised portion 246*a* and also the lower rim of 246*c* of anvil 246, priming composition P can be ignited with either rimfire or center fire type firing pins.

Figures 13, 14, 15:
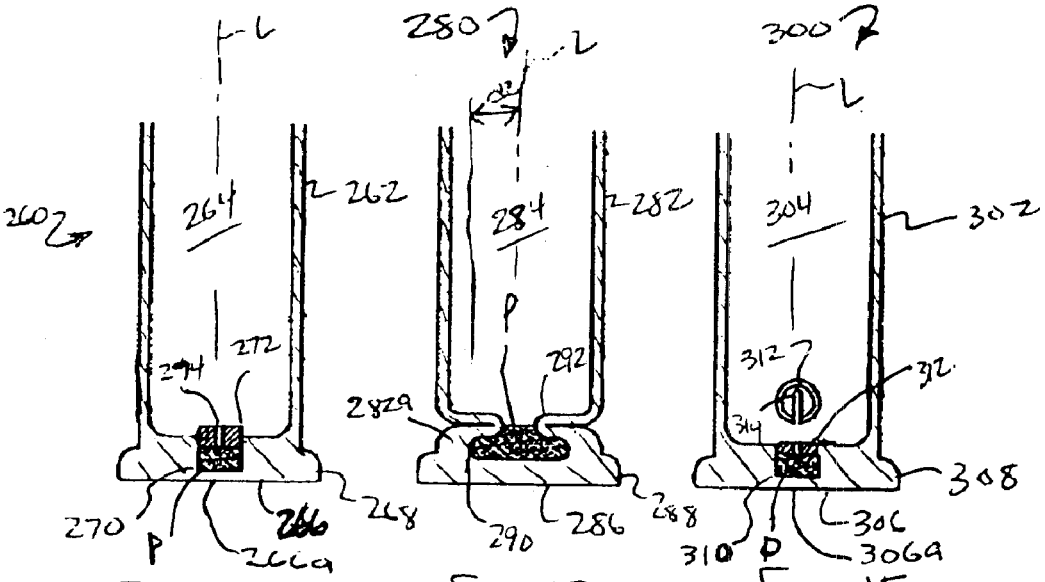
FIG. 13 is a cross-sectional view of another embodiment casing.
FIG. 14 is a cross-sectional view of another embodiment casing.
FIG. 15 is a cross-sectional view of another embodiment casing.

Referring now to FIG. 13, another embodiment modified rimfire cartridge casing 280 is provided. Casing 280 includes a wall 282 and an end member 286, which define a hollow interior 284. A flange member 288 extends radially from end member 286 about the outer surface of wall 282. A recess 290 is formed by crimping or otherwise deforming wall 282 to form an anvil 292 with the inwardly extending portion of wall 282. Recess 290 is located at distance d2 from center axis L. Anvil 292 forms with end member 286 a recess 290 for receiving priming composition P. In the illustrated embodiment, the lower portion 282*a* of wall 282 around recess 290 is thickened to strengthen the cartridge casing and prevent blowout of the wall surrounding priming composition P. Anvil 292 can extend around all or a portion of recess 290. Anvil 292 has a center opening that allows the flash from priming composition P to ignite powder or propellant in hollow interior 284 when the firing pin compresses priming composition P between anvil member 292 and end member 286.

Referring now to FIG. 14, another embodiment center fire cartridge casing 260 is provided. Casing 260 includes a wall 262 and an end member 266, which define a hollow interior 264. A flange member 268 extends radially from end member 266 about the outer surface of wall 262. A recess 270 is formed in end member 266 to receive priming composition P. An anvil 272 is secured in recess 270. Anvil 272 and includes a vent opening 274 therethrough to vent the flash from priming composition P to ignite powder or propellant in hollow interior 264 when the firing pin compresses priming composition P between anvil 272 and the reduced thickness portion 266*a* of end member 266. Anvil 272 can be press fit, glued, threadingly engaged or otherwise secured in recess 270.

Referring now to FIG. 15, another embodiment center fire cartridge casing 300 is provided. Casing 300 includes a wall 302 and an end member 306, which define a hollow interior 304. A flange member 308 extends radially from end member 306 about the outer surface of wall 302. A recess 310 is formed in end member 306 to receive priming composition P. An anvil 312 includes a slotted vent opening 314 therethrough that vents the flash from priming composition P to ignite powder or propellant in hollow interior 304 when the firing pin compresses priming composition P between anvil 312 and the reduced thickness portion 306*a* of end member 306. Anvil 312 can be in the form of a snap ring that is compressed radially for insertion into recess, and then returns toward its original configuration to engage the sidewalls of recess 310. The sides of anvil 312 can be provided with a sharp edge to bite into the recess sidewalls.

Figures 16A, 16B, 16C:
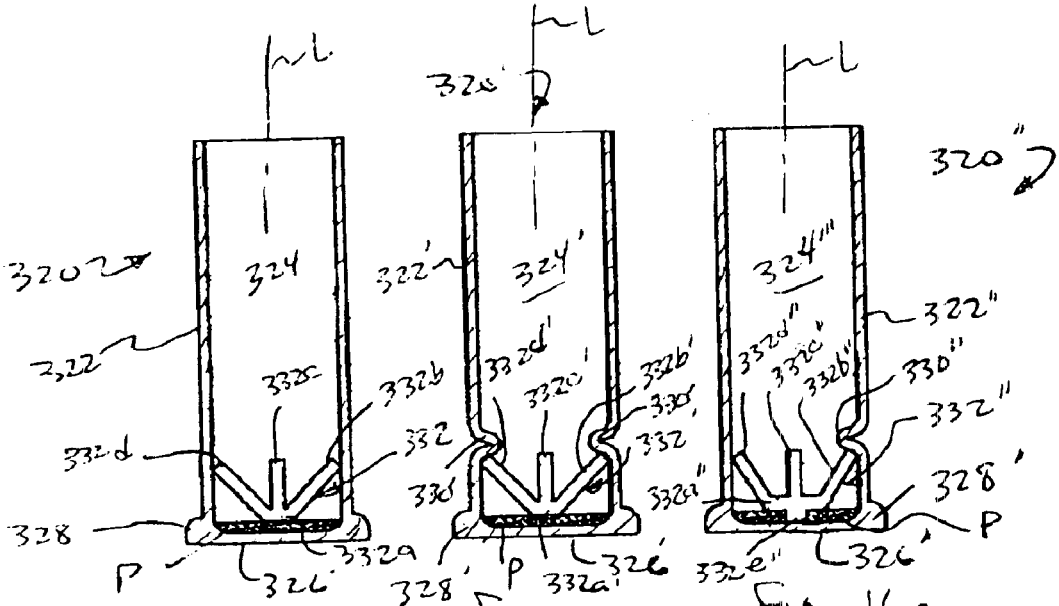
FIGS. 16*a*, 16*b*, 16*c* are cross-sectional views of another embodiment casing.

Referring now to FIGS. 16*a*–16*c*, there is illustrated various embodiments of a center fire cartridge casing having an anvil press fit therein. In FIG. 16*a*, casing 320 includes wall 322 and end member 326, which define a hollow interior 324. Flange 328 extends radially outwardly from end member 326 about the outer surface of wall 322. Priming composition P is placed in hollow interior 324 adjacent end member 326. Anvil 332 is press fit or placed into hollow interior 324 with base portion 332*a* in contact with priming composition P. Arms 332*a*, 332*b*, 332*c* extend outwardly from base portion 332*a* and engage wall 322 to hold anvil 332 in position. The ends of arms 332*a*, 332*b*, 332*c* can bite into or frictionally engage the inner surface of wall 322. Although three arms 332*a*, 332*b*, 332*c* are shown in FIG. 16*a*, more than three arms and only two arms are also contemplated.

In FIG. 16*b*, casing 320' includes wall 322' and end member 326', which define a hollow interior 324'. Flange 328' extends radially outwardly from end member 326' about the outer surface of wall 322'. Priming composition P is placed in hollow interior 324' adjacent end member 326'. Anvil 332' is press fit or placed into hollow interior 324' with base portion 332*a*' in contact with priming composition P. Arms 332*a*', 332*b*', 332*c*' extend outwardly from base portion 332*a*' and engage wall 322' to hold anvil 332' in position. It is further contemplated that wall 322' can be crimped or otherwise deformed to provide inward extension 330' extending about the perimeter of wall 322'. The ends of arms 332*a*', 332*b*', 332*c*' can bite into or frictionally engage inward extension 330'. Although three arms 332*a*', 332*b*', 332*c*' are shown in FIG. 16*b*, more than three arms and only two arms are also contemplated.

In FIG. 16*c*, casing 320" includes wall 322" and end member 326", which define a hollow interior 324". Flange 328" extends radially outwardly from end member 326" about the outer surface of wall 322". Priming composition P is placed in hollow interior 324" adjacent end member 326". Anvil 332" is press fit or placed into hollow interior 324" with base portion 332*a*" in contact with priming composition P. Anvil 332' further includes a depth stop 332*e*" that engages end member 326' when anvil 332" is at the proper depth in casing 320". Arms 332*a*", 332*b*", 332*c*" extend outwardly from base portion 332*a*" and engage wall 322" to hold anvil 332" in position. It is further contemplated that wall 322" can be crimped or otherwise deformed to provide one or more inward extensions 330". In the illustrated embodiment, one inward extension is provided for engagement with the end of arm 332*b*'. Arms 332*a*", 332*b*", 332*c*" can bite into or frictionally engage inward extension 330", if so provided adjacent thereto, or the inner surface of wall 322". Although three arms 332*a*", 332*b*", 332*c*" are shown in FIG. 16*c*, more than three arms and only two arms are also contemplated.

Figure 17:
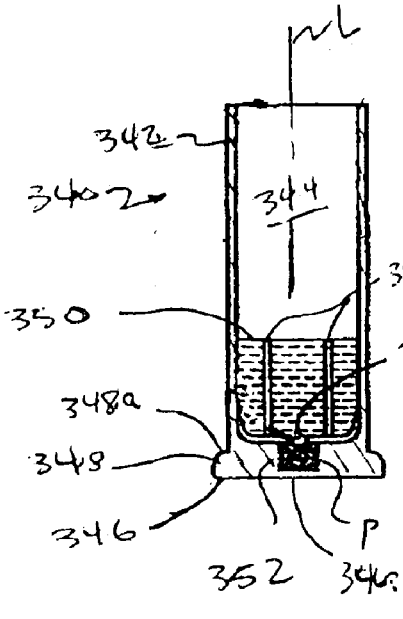
FIG. 17 is a cross-sectional view of another embodiment casing.

Referring now to FIG. 17, there is shown another embodiment center fire cartridge casing 340. Casing 340 includes a wall 342 and an end member 346, which define hollow interior 344. A flange 348 extends radially outwardly from end member 346 and includes a lip 348*a* around the outer surface of wall 342. End member 346 includes a recess 352 form therein to receive priming composition P. Propellant pellet 350 is placed in hollow interior 344, and includes an anvil 350*a* positioned against priming composition P. Anvil 350*a* can be of the same material as propellant pellet 350 or of another material. Anvil 350*a* can be integrally formed with pellet 350 or a separate component. A firing pin (not shown) striking reduced thickness portion 346*a* of end member 346 compresses priming composition P against anvil 350*a*. The flash from priming composition P ignites the progressively burning propellant pellet 350, which includes vents 350*b* formed therethrough to facilitate burning of propellant pellet 350.

Figure 18:
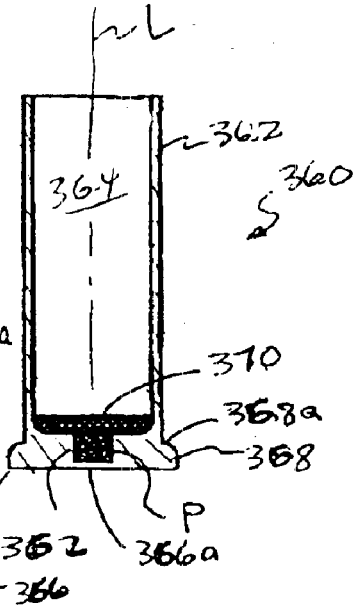
FIG. 18 is a cross-sectional view of another embodiment casing.

Referring now to FIG. 18, there is shown another embodiment center fire cartridge casing 360. Casing 360 includes a wall 362 and an end member 366, which define a hollow interior 364. A flange 368 extends radially outwardly from end member 366 and includes a lip 368*a* around the outer surface of wall 362. End member 366 includes a recess 362 form therein to receive priming composition P. Anvil 370 is placed in hollow interior 344. Anvil 370 can be a primer pellet formed from a combination of priming composition and glue or other substance that provides sufficient rigidity so the priming composition can function as an anvil. A firing pin (not shown) striking reduced thickness portion 366*a* of end member 366 compresses priming composition P against anvil 370. The flash from priming composition P ignites the anvil 370 which in turn ignites the powder or propellant in hollow interior 364.

Figure 19:
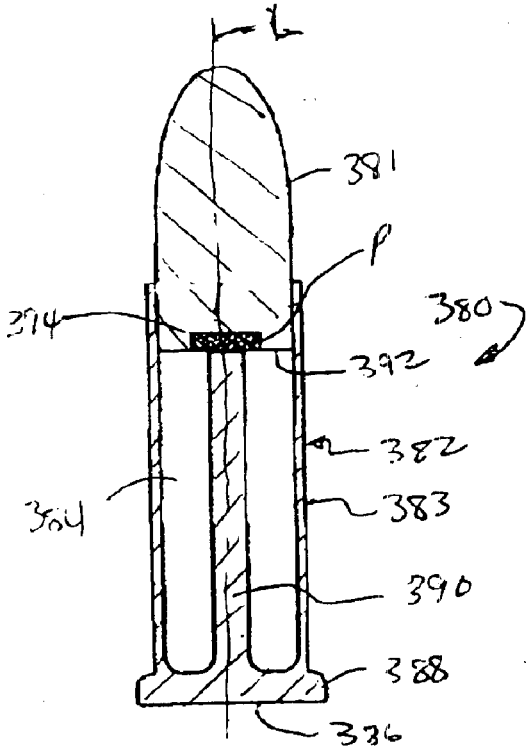
FIG. 19 is a cross-sectional view of another embodiment firearm cartridge.

Referring now to FIG. 19, there is provided a center fire cartridge 380 that includes a bullet 381 coupled to casing 382. Casing 382 includes a wall 383 and an end member 386. A flange 388 extends radially from end member 386 about the outer surface of wall 383. An anvil 390 extends from end member 386 through hollow interior 384 to bullet 381. Anvil 390 can be integrally formed with end member 386 or attached thereto, and is an elongated rod-like member that extends substantially through casing 382.

Bullet 381 includes an end face 392 having a recess 394 for receiving priming composition P. A firing pin (not shown) striking end member 386 at anvil 390 compresses priming composition P between the opposite end of anvil 390 and bullet 381. The flash from the priming composition P ignites powder or propellant in hollow interior 384 around the anvil 390, which in turn fires bullet 381 from casing 382.

Figure 20:
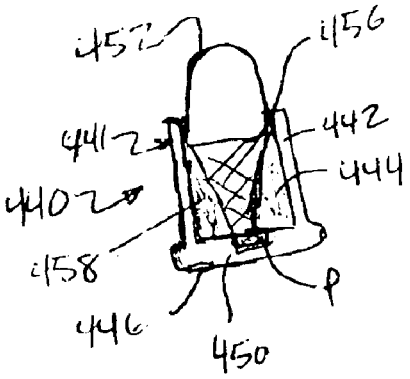
FIG. 20 is a cross-sectional view of another embodiment firearm cartridge.

Referring now to FIG. 20 there is shown another embodiment center fire cartridge 440. Cartridge 440 includes a casing 441 having a generally cylindrical wall 442 and an end member 446, which define a hollow interior 444. End member 446 can be provided with a recess 450 for priming composition P. A bullet or projectile 452 is attached to the end of casing 441 opposite end member 446. A solid propellant pellet 456 has one end in contact with or attached to the end of bullet 452 in casing 441, and extends to an opposite end positioned over recess 450 to serve as an anvil. Grain propellant or powder 458 is in hollow interior 444 around solid propellant pellet 456.

Figures 21A, 21B:
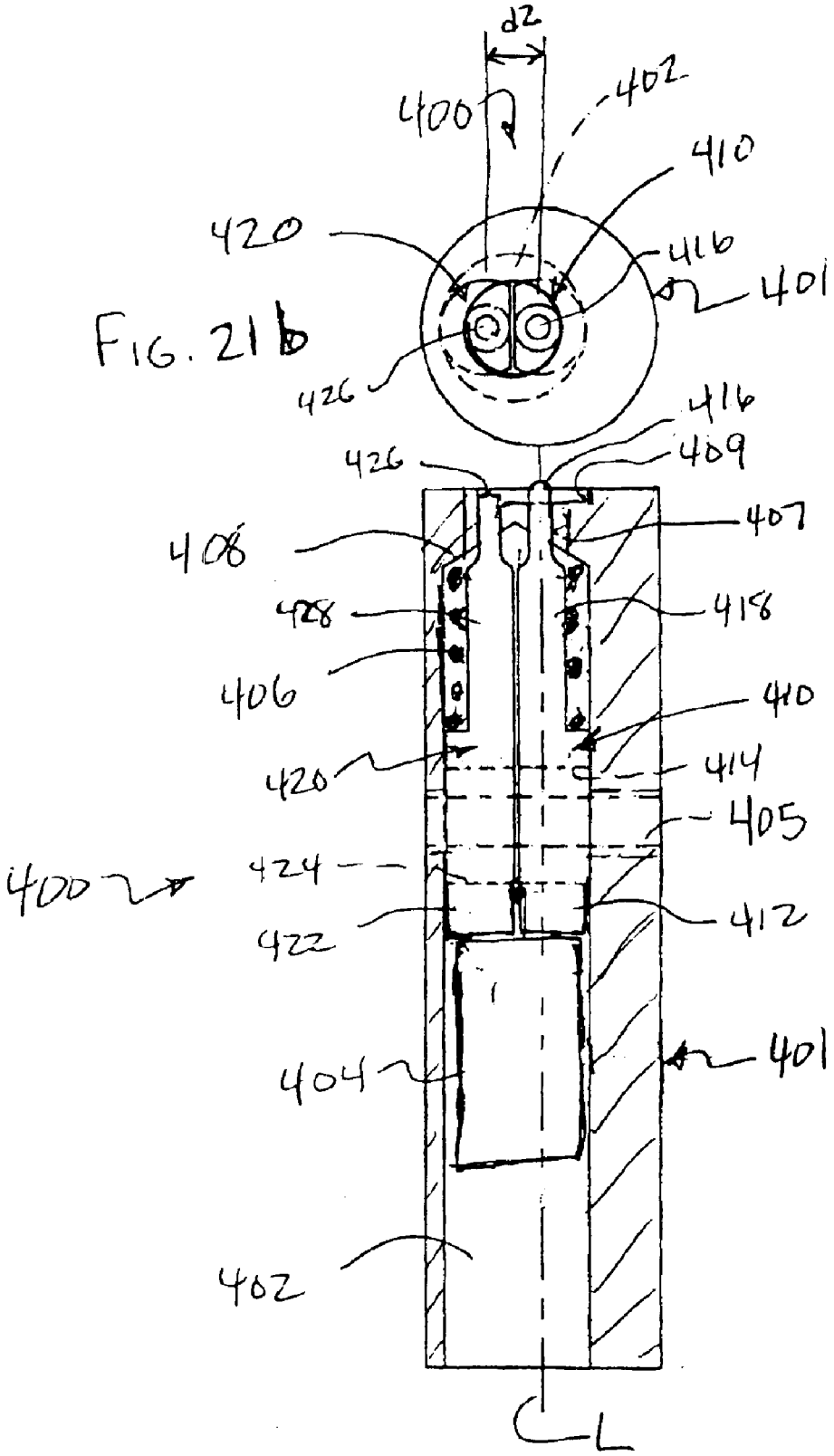
FIGS. 21*a* and 21*b* are a partial cross-sectional view and end view, respectively, of another embodiment firing pin system.

Referring now to FIGS. 21*a* and 21*b*, another embodiment firing pin system 400 is provided that is configured to detonate the priming compositions of center fire cartridges and also the modified rimfire cartridges discussed herein. Details of the positioning of bolt 401 in the firearm are not shown but are known and understood by those skilled in the art. Bolt 401 includes a passage 402 housing firing pins 410 and 420 along with a striker 404. Bolt 401 includes an end wall 408 at the end of passage 402 against which spring 406 is positioned. Bolt 401 further includes a stop member 405 extending therethrough and also extending through firing pins 410 and 420. Bolt 401 includes a recess 409 at the end thereof sized to accommodate the end of the cartridge to be fired.

Firing pin 410 and firing pin 420 are positioned in side-by-side relation in passage 402, but can also be formed as a single unit. Firing pin 410 includes a body portion 412 with a slot 414 therein to receive stop member 405. Firing pin 410 includes a striking end 416 extendable through the end opening 407 of bolt 401. Firing pin 410 further includes an intermediate portion 418 that forms a lip with body portion 412 for engagement with spring 406. Firing pin 420 includes a body portion 422 with a slot 424 therein to receive stop member 405. Firing pin 420 includes a striking end 426 extendable through the end opening 407 of bolt 401. Firing pin 420 further includes an intermediate portion 428 that forms a lip with body portion 422 for engagement with spring 406.

Striking end 426 of firing pin 420 is positioned at a distance d2 from centerline axis L, and striking end 416 of firing pin 410 is positioned along axis L. Striking end 416 is positioned to detonate the primer of the center fire type cartridges, including those discussed above. Striking end 416 can be rounded or pointed to facilitate penetration into or through the end member of the cartridge casing. Striking end 426 is positioned to detonate the priming composition of the modified rimfire cartridges discussed above wherein the priming composition is offset at distance d2 from the center axis L of the cartridge. Striking end 426 can be flat or more blunt than striking end 416 since striking end 426 need not penetrate as far into the end member of the casing. When striker 404 contacts the ends of firing pins 410, 420, firing pins 410, 420 are moved toward the end of the casing of the chambered cartridge. Striking end 416 contacts the cartridge casing along axis L before striking end 426 contacts the end of the cartridge casing. Advancement of firing pins 410, 420 continues so that striking end 426 deforms, crushes or penetrates the end of the cartridge at d2.

Advancement of firing pins 410, 420 into the cartridge is limited by stop member 405, which engages one end of the slots 414, 424 when the striker 404 sufficiently advances firing pins 410, 420 in bolt 401 toward the end member of the cartridge casing. With the momentum of striker 404 arrested by stop member 405, spring 406 returns firing pins 410, 420 and striker 404 to their pre-firing position in bolt 401. If the rifle is fired dry (unloaded), movement of striking end 426 can be arrested by stopping member 405 before striking end 426 contacts the cartridge chamber of the rifle, preventing damage to the firing pin and cartridge chamber.

Figure 22:
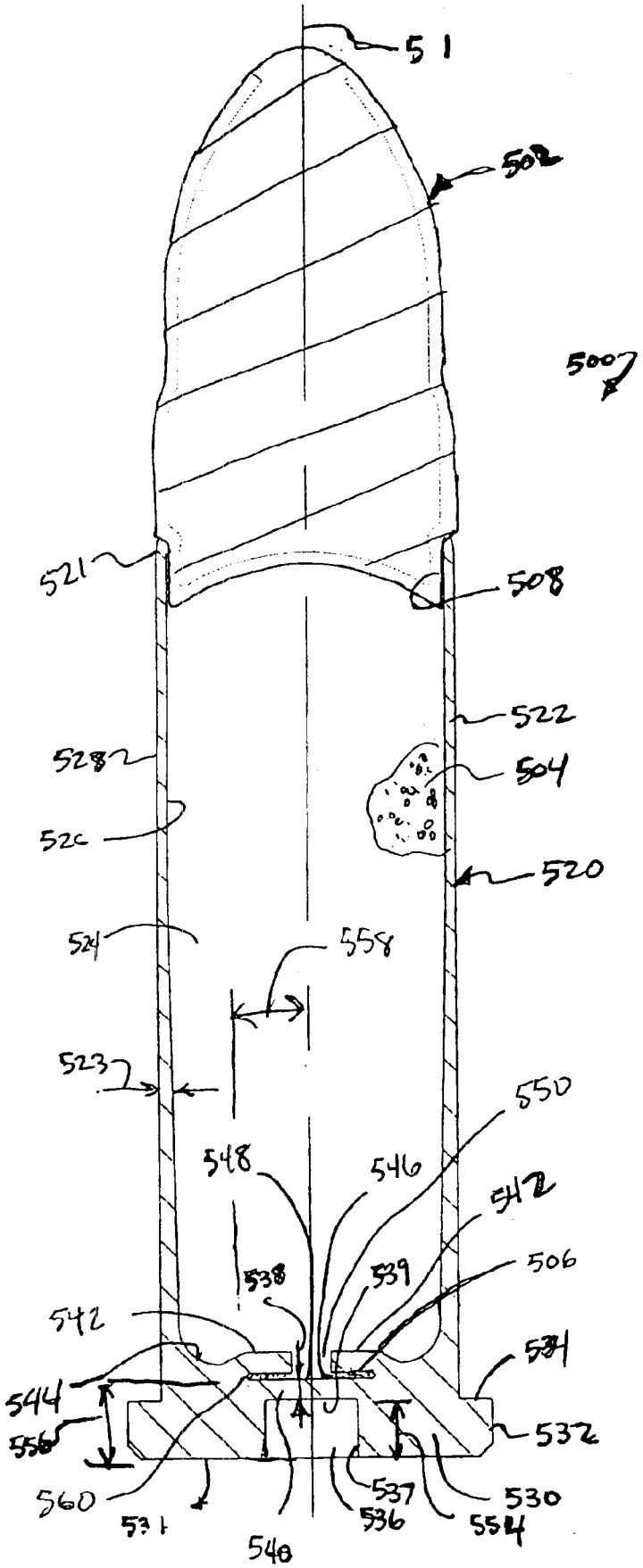
FIG. 22 is a cross-section of another embodiment firearm cartridge.

A cartridge having application with firing pin system 400 is also shown in FIG. 22. Cartridge 500 includes a casing 520 and a bullet 502 extending along a central axis 501. Bullet 502 includes a distal or rearward end portion 508 coupled to a proximal or forward end 521 of casing 520. Casing 520 includes a cylindrical wall 522 having an inner surface 526 and opposite outer surface 528. Inner surface 526 defines a chamber 524 of a generally cylindrical configuration about centerline axis 501. Wall 522 includes a thickness 523 between inner and outer surfaces 526, 528 that tapers toward forward end 521. Other configurations for wall 522 are contemplated, including a wall with stepped regions of differing thickness, walls with uniform thickness, walls with recesses and offsets, and walls of non-cylindrical form, for example.

Casing 520 includes an end member 530 intersected by longitudinal axis 501. A flange 532 extends about end member 530 and radially outwardly projects therefrom about longitudinal axis 501. Flange 532 forms an annular lip 534 extending about outer wall surface 528. In the illustrated embodiment, flange 532 is a solid rim that reinforces casing 520 in the region where wall 522 meets end member 530. Also contemplated is a casing 520 that does not include a flange forming an annular lip with the wall of the casing.

End member 530 includes a receptacle 536 extending therein toward forward end 521. Receptacle 536 is formed about longitudinal axis 501, and includes a lateral wall surface 537 and an outer striker member surface 539. Other embodiments contemplate that receptacle 536 is off-center from longitudinal axis 501. Striker member surface 539 extends along a striker member 540 formed by a reduced wall thickness portion of end member 530. In the illustrated embodiment, striker member 540 is formed along a forward end of receptacle 536. An inner striker member surface 548 opposite outer striker member surface 539 extends along a portion of primer recess 546.

Primer recess 560 includes an end 560 formed by the junction of end member 530 and projection 542. Primer recess 546 includes a lateral depth 558 such that end 560 of primer recess 546 is spaced outwardly from receptacle 536 and striker member 540. Accordingly, this allows priming composition 506 to be placed, at least partially, in a location that is offset laterally from central axis 501 in manner that mimics a rimfire cartridge, but spaces end 560 away from wall 522 where casing 520 is susceptible to failure.

Wall 522 and end member 530 define hollow interior 524. End member 530 includes a bottom surface 544 in communication with hollow interior 524. Anvils or projections 542 extend from bottom surface 544, and projections 542 extend along striker member 540 to form primer recess 546 therebetween. Projections 542 define a primer passage 550 providing communication between primer recess 546 and interior 524. A priming composition 506 can be placed in primer recess 546. Compression of striker member 540 against projection 542 crushes priming composition 506, which creates a flash through primer passage 550 to ignite propellant 504 in hollow interior 524.

End member 530 includes a thickness 556 between outer end surface 531 of end member 530 and inner striker member surface 548 of striker member 540. Receptacle 536 includes a depth 554 into end member 530 from outer end surface 531 to outer striker member surface 539. Striker member 540 includes a thickness 538 between outer striker member surface 539 and inner striker member surface 548. Depth 554 is at least one half of thickness 556. In one embodiment, depth 554 is about three-fourths of the thickness 556. Receptacle 536 remains unobstucted to facilitate receipt of a striking end of a firing pin to engage striker member 540.

Receptacle 536 and striker member 540 are positioned for striking by an end of a center fire firing pin, such as striker end 416 of firing pin 410 shown in FIGS. 21*a* and 21*b*. In operation, thickness 538 is provided so that striker member 540 is deformable by striker end 416 to compress priming composition 506 in primer recess 546 against projection 542. Thickness 556 of end member 530 is provided such that striker end 426 of rim fire striker 420, or the striking pin of any standard rimfire firing pin, does not substantially deform end member 430 when contacting outer end surface 531. Thus, engagement of end member 430 by a rimfire firing pin does not result in firing of the cartridge, as could result with standard centerfire cartridges.

Striker member 539 is integrally formed with end member 530. In addition, projections 542 are integrally formed with casing 520, and in particular end member 530. This simplifies manufacture of casing 520. Casing 520 can be provided initially with a sufficient material thickness along end member 530 to accommodate forming of receptacle 536 and also projections 542 in a forwardly extending position from end member 530. Projections 542 can then be bent or formed relative end member 530 to form primer recess 546 forwardly of striker member 540.

As shown in FIG. 22, primer recess 546 and striker member 540 are positioned forwardly of flange 532. Receptacle 536 includes depth 554 sufficient to position outer striker wall surface 539 forwardly of flange 532. Primer recess 546 and thus priming composition 506 are located forwardly of end member 530 and striker member 540. So positioned, the thickness of end member 530 in combination with the positioning and isolation of priming composition 506 and striker member 540 strengthens end member 530 adjacent to wall 522, enabling cartridge 500 to be loaded with a substantially greater quantity or charge of propellant generating substantially greater pressure to obtain greater bullet velocity. Cartridge 500 can be employed by replacing the firing pin of a rimfire firing pin system with firing pin system 400. So modified, the firearm can fire centerfire cartridge 500, which isolates primer 506 from the striker of rimfire firing pin 420, and also rimfire cartridges While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A firearm cartridge, comprising a casing including:

a generally cylindrical wall extending between a forward end and an opposite end member;

a hollow interior formed by said wall and said end member;

a projection in said hollow interior extending along said end member, at least a portion of said projection being spaced from said end member;

said end member including an outer end surface at a rearward end thereof and a receptacle formed in said end member opening at said outer end surface, said receptacle extending forwardly into said end member to a striker member, said striker member being integral with said end member;

a recess formed between said projection and said end member, said striker member extending along said recess, said recess including an end formed between said projection and said end member, said end extending about said receptacle and said striker member; and priming composition in said recess, wherein said striker member is deformable by a firing pin positioned in said receptacle to compress said priming composition in said recess.

2. The cartridge of claim 1, wherein said projection is integrally formed with said end member.

3. The cartridge of claim 1, wherein said receptacle is cylindrical.

4. The cartridge of claim 1, further comprising a bullet connected to said forward end of said casing.

5. The cartridge of claim 1, further comprising propellant in said hollow interior.

6. The cartridge of claim 1, wherein said projection forms a passage providing communication between said recess and said hollow interior.

7. The cartridge of claim 1, wherein said projection extends from an inner surface of said end member, said inner surface extending along said hollow interior.

8. The cartridge of claim 1, wherein said end member includes a thickness between said outer end surface and said recess, said receptacle including a depth that is greater than one half of said thickness.

9. The cartridge of claim 8, wherein said depth is about three-fourths of said thickness.

10. The cartridge of claim 1, wherein said receptacle is centered along a central longitudinal axis of said casing.

11. The cartridge of claim 10, wherein said recess is formed radially about said central longitudinal axis.

12. A firearm cartridge, comprising a casing including:

a generally cylindrical wall extending between a forward end and an opposite rearward end member;

a hollow interior formed by said wall and said end member;

said end member including a rearwardly facing outer end surface at a rearward end thereof and a receptacle formed in said end member opening at said outer end surface, said receptacle extending forwardly into said end member to a striker member integral with said end member;

a projection in said hollow interior extending along said end member, at least a portion of said projection being spaced forwardly from said end member; and a recess for receiving priming composition between said projection and said end member, said recess being spaced forwardly of said striker member and extending to an end extending about said striker member.

13. The cartridge of claim 12, wherein said striker member is deformable by a firing pin positioned in said receptacle to compress said priming composition between said striker member and said projection.

14. The cartridge of claim 13, wherein said projection is integrally formed with said casing.

15. The cartridge of claim 14, wherein said projection is integrally formed with said end member.

16. The cartridge of claim 12, wherein said projection forms a passage providing communication between said recess and said hollow interior.

17. The cartridge of claim 12, wherein said projection extends from an inner surface of said end member, said inner surface extending along said hollow interior.

18. The cartridge of claim 12, wherein said end member includes a thickness between said outer end surface and said recess, said receptacle including a depth that is greater than one half of said thickness.

19. The cartridge of claim 12, wherein said receptacle is centered along a central longitudinal axis of said casing.

* * * * *

UNITED STATES PATENT AND TRADEMARK OFFICE

CERTIFICATE OF CORRECTION

PATENT NO. : 6,959,647 B2 
DATED : November 1, 2005
INVENTOR(S) : S. Paul Reynolds and George L. Reynolds It is certified that error appears in the above-identified patent and that said Letters Patent is hereby corrected as shown below:

Title page,
Item [73], Assignee, change "Wistrom" to -- Westrom --.

Signed and Sealed this

Twenty-eighth Day of March, 2006

JON W. DUDAS
*Director of the United States Patent and Trademark Office*